United States Patent [19]

Chen Dai

[11] Patent Number: 4,655,456

[45] Date of Patent: Apr. 7, 1987

[54] BUDO COMPLEX WEAPON

[76] Inventor: Yin-Chiao Chen Dai, No. 13, Hsi Chang Rd., Feng-Lung Tsun, Chia-Tung Hsiang, Pingtung Hsien, Taiwan

[21] Appl. No.: 457,697

[22] Filed: Jan. 13, 1983

[51] Int. Cl.[4] ..... F41B 15/00

[52] U.S. Cl. ..... 273/84 R; 446/85

[58] Field of Search ..... 273/84 R; 446/123, 124, 446/125, 126

[56] References Cited

U.S. PATENT DOCUMENTS

| | | | |
|---|---|---|---|
| 1,179,611 | 4/1916 | Cilley | 273/84 R |
| 2,609,638 | 9/1952 | Lindenmeyer | 446/124 X |
| 3,355,837 | 12/1967 | Pedersen | 446/123 X |
| 4,052,063 | 10/1977 | Wong | 273/84 R |
| 4,132,409 | 1/1979 | Taylor | 273/84 R |

*Primary Examiner*—George J. Marlo

*Attorney, Agent, or Firm*—Cushman, Darby & Cushman

[57] ABSTRACT

A Budo Complex Weapon assembled from six different elements. The six interconnectable elements are assembled to provide eight different kinds of a budo weapon. Budo weapons include the Sai, Yin Yang Sai, Manji Sai, Jute, Yawara, Buffalo Hook, Manji Hook and Kubotan.

2 Claims, 22 Drawing Figures

BUDO COMPLEX WEAPON

FIELD OF THE INVENTION

The present invention provides six inter connectable members which can be assembled to make different Budo complex weapons. Many kinds of Budo weapons can be assembled depending on which of the six elements are selected and assembled together.

BACKGROUND OF THE INVENTION

Budo is a very meaningful exercise which is widely accepted and practiced throughout the whole world. Budo has wide applicability. Doing Budo exercises can build up a healthy body. Knowledge of Budo exercises and self-defense techniques can protect the practitioner from the attack of evil people. Budo has wide applicability. The exercise of Budo with related Budo complex weapons is indispensable in building up our capabilities and varies very much in the genre, like Sai, Yin Yang Sai, Manji Sai, Jute, Yawara, Buffalo Hook, Manji Hook, Kubotan and the like.

The Budo weapon, either traditional or recorded in prior arts, are separate individual one-piece weapons. The exercisers must prepare and use every kind of the weapon to complete the exercise. This is cumbersome and causes much inconvenience. Furthermore, it will increase the burden of the exercisers.

SUMMARY AND OBJECTS OF THE INVENTION

The present invention is related to six different interconnectable members which can be variously assembled into a Budo complex weapon and the thus assembled weapon. In the present invention, eight different kinds of Budo weapons, such as the Sai, Yin Yang Sai, Manji Sai, Jute, Yawara, Buffalo Hook, Manji Hook and Kubotan can be assembled according to their special nature of assembly.

In accordance with another aspect, the present invention provide a first member. The first member is composed of a bar portion and a bolt portion which extends from one end of the central line of the bar.

In accordance with another aspect of the present invention to provide a second member, it is composed of a bar portion too but at the end of the bar portion is an internal thread.

In accordance with another aspect, the present invention provides a third member. The third member is composed of a short bolt portion, a flange portion next to the bolt portion and a bulge portion.

In accordance with another aspect, the present invention provides a fourth member. The fourth member is composed of an empty sleeve nut with internal thread and an outer covering leather for gripping.

In accordance with another aspect, the present invention provides a fifth member. The fifth member is composed of a transverse portion which has a hole and longitudinal portion which is about parallel to the central point of said hole.

In accordance with another aspect, the present invention provides a sixth member. The sixth member is composed of a head portion which has a through hole, a fixed hook which extends from the head portion and both are on the same trunk, and a movable hook which extends from another end of the head portion and has a surface with the head portion. The surface is about parallel to the central line of the through hole of the head portion, therefore there are two kinds of connections between the head portion and the movable hook. The first connection is a movable hook which relates to the central line of the through hole, and has a symmetrical relation with the fixed hook. The second connection is a movable hook which passes the central point of the surface and the vertical line of the surface, and has a symmetrical relation with the movable hook in the first position.

Another embodiment of the present invention provides one pair of Sai. Each Sai is composed of a first member, a third member, a fourth member and a sixth member in first position.

Another embodiment of the present invention provides one pair of Yin Yang Sai. Each Yin Yang Sai is composed of a first member, a third member, a fourth member and a sixth member in the second position.

Another embodiment of the present invention is a Manji Sai. It is composed of a first member, a second member and a sixth member in the second position.

In accordance with another aspect of the present invention is the provision of a Jute. It is composed of a first member, a third member, a fourth member and a fifth member.

In accordance with another aspect of the present invention is the provision of a Yawara. It is composed of two third members and a fourth member.

In accordance with another aspect of the present invention is the provision of a Buffalo Hook. Actually it is the sixth member in the first position.

In accordance with another aspect of the present invention is the provision of a Manji Hook. Actually it is the Sixth member in second position.

In accordance with still another aspect of the present invention is the provision of a Kubotan. Actually it is the fourth member.

In accordance with another aspect of the present invention is the provision of disposable members for easy carrying and storage.

In accordance with another aspect of the present invention is the provision of members which have an inner-relationship among themselves and can be variously assembled at one's desire from the first to the eighth kind of Budo weapon.

BRIEF DESCRIPTION OF THE DRAWINGS

Embodiments of the invention are described in the following detailed description taken in connection with the accompanied drawings wherein.

DETAILED DESCRIPTION PREFERRED EXEMPLARY EMBODIMENT

One embodiment of the subject invention is an apparatus and/or apparatus kit having a plurality of interconnectable structural elements. This apparatus comprise a first element having a bar portion with a top and bottom bar portion, a threaded bolt extending from the bottom portion of T bar portion; a second element having a bar portion, the bar portion have a base, a centralized threaded core extending upwardly a predetermined distance from the base; a third element having a threaded bolt portion one end of which connects to a flange portion, and a butt portion extending from the rear end of the flange portion; a fourth element is a hollowed sleeve nut; a fifth elemtn having a transverse portion and a longitudinal section, an opening in the transverse portion, a notch in said opening; and a sixth element having a central section, the central section having a through hole, the through hole having a notch of at least one end thereof, a fixed hook extending from one side of said central portion, and an adjustable hook mounted on the central portion; and means for locking the movable hook in a predetermined fixed relationship to the central portion.

Another embodiment is an apparatus kit having a plurality of interconnectable structural elements comprising an element having a bar portion with a top and bottom bar portion, a threaded bolt extending from the bottom portion of the bar portion; an element having a threaded bolt portion one end of which connects to a flange portion, and a butt portion extending from the rear end of the flange portion; a hollowed sleeve nut; and an element having a central section, the central section having a through hole, the through hole having a notch of at least one end thereof, a fixed hook extending from one side of the central portion, and an adjustable hook mounted on the central portion; and means for locking the movable hook in a predetermined fixed relationship to the central portion.

Figure 1:
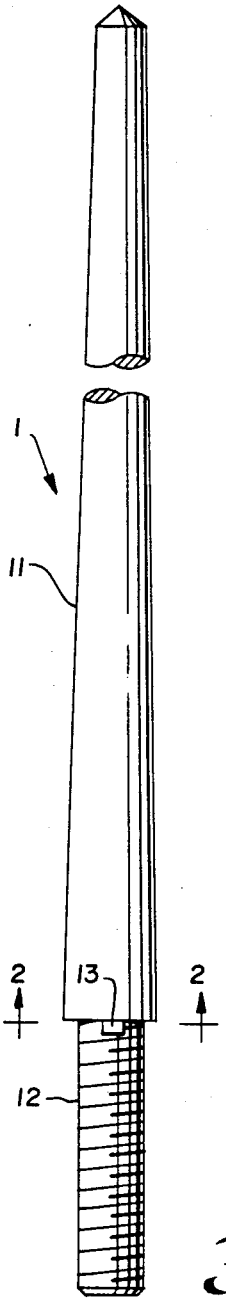
FIG. 1 is a front view showing the first member in connection with the present invention.
Figure 2:
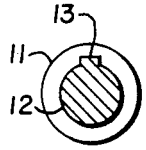
FIG. 2 is a cross sectional view taken along cut line I—I of FIG. 1.

To further illustrate the instant invention, please refer to FIG. 1. FIG. 1 is the authentic example of the first member of the present invention. The first member has a bar portion 11, a bolt 12 extending from the rear end of said bar portion 11 and key 13 (see FIG. 12) bulging on the surface of bolt 12 and in between bar portion 11 and bolt 12.

Figure 3:
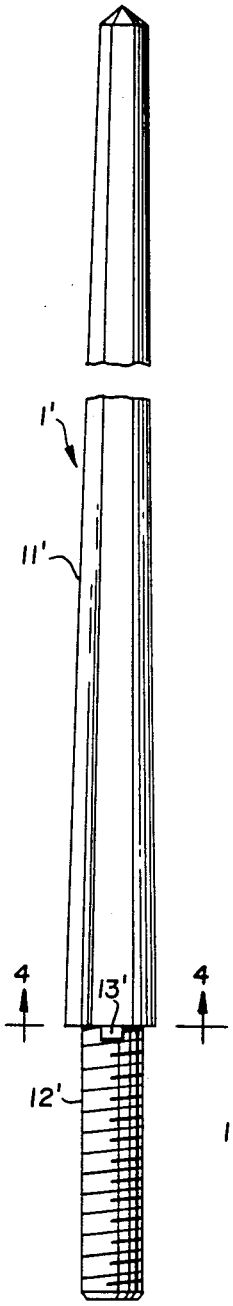
FIG. 3 is a front view of another example of the first member of FIG. 1.
Figure 4:
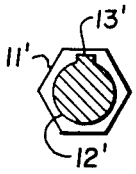
FIG. 4 is a cross sectional view taken along cut line II—II of FIG. 3.

FIG. 3 is another authentic example of the first member of the present invention. The first member also has a bar portion 11, a bolt 12 extending from the rear end of bar portion 11 and a key 13 bulging on the surface of bolt 12 and in between bar portion 11 and bolt 13. Only the bar portion 11 has a cross-section in a hexagon shape (or polygon) (see FIG. 4).

Figure 5:
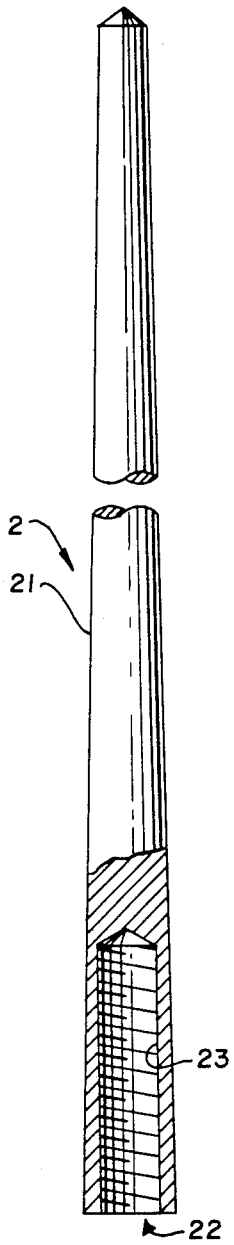
FIG. 5 is a front view showing the second member in accordance with the present invention.

FIG. 5 is an authentic example of the second member of the present invention. The second member also has a bar portion 21. A hole 22 is at the rear end of bar portion 21 at its axial direction. Inside the hole is the internal thread 23.

Figure 6:
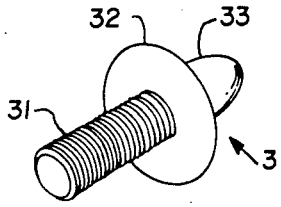
FIG. 6 is a perspective view showing the third member in accordance with the present invention.
Figure 7:
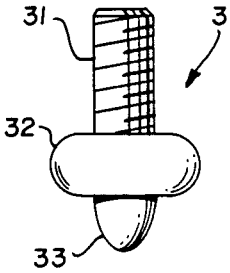
FIG. 7 is a front view showing the third member of FIG. 6.

In FIG. 6 and FIG. 7 are authentic examples of the third member of the present invention. The third member has a bolt portion 31, a flange portion 32 next to bolt portion 31 and a bulge portion 33 extending from the rear end of flange portion 32. The diameter of flange portion 32 is larger than that of bolt portion 31 and bulge portion 33.

Figure 8:
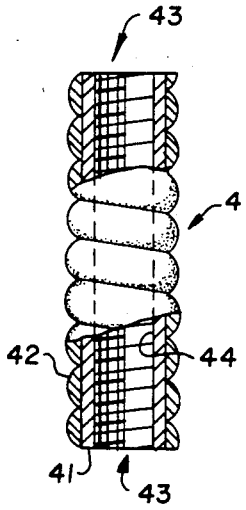
FIG. 8 is a broken sectional view showing the fourth member in accordance with the present invention.
Figure 9:
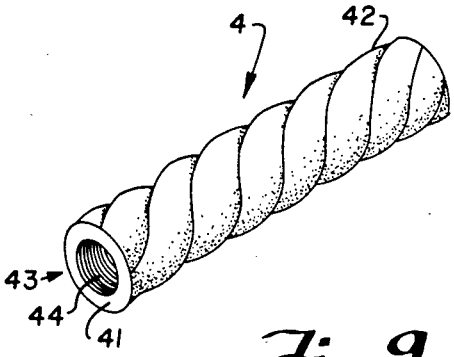
FIG. 9 is a perspective view of the fourth member of FIG. 8.

In FIG. 8 and FIG. 9 are authentic examples of the fourth member of the present invention. The fourth member has an empty sleeve nut 41, a through hole 43 inside at its axial direction and an outer covering leather for gripping. An internal thread 44 is in the inside wall of through hole 43.

Figure 10:
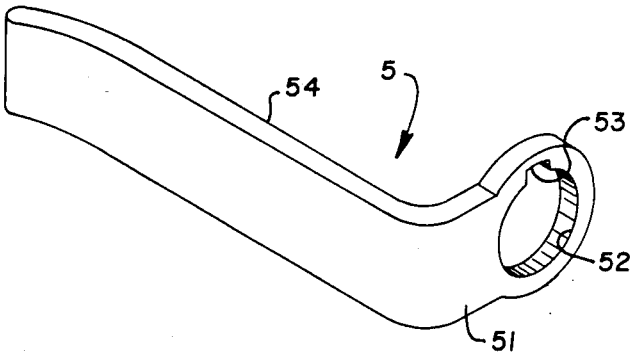
FIG. 10 is a perspective view showing the fifth member in accordance with the present invention.

FIG. 10 is an authentic example of the fifth member of the present invention. The fifth member has a transverse portion 51 which has a longitudinal hole 52 with a key way 53 in its wall, and a longitudinal portion 54 extending substantially perpendicularly from the transverse portion. Thus, the longitudinal portion has a relation to about 90 degree with the transverse portion 51.

Figure 11:
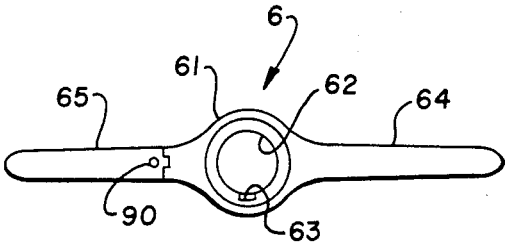
FIG. 11 is a top view of FIG. 12 showing the sixth member in accordance with the present invention.
Figure 12:
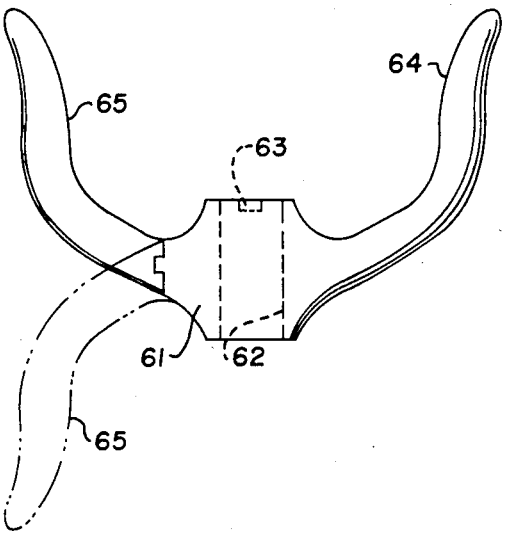
FIG. 12 is a front view showing the sixth member in accordance with a present invention.
Figures 13, 14, 15:
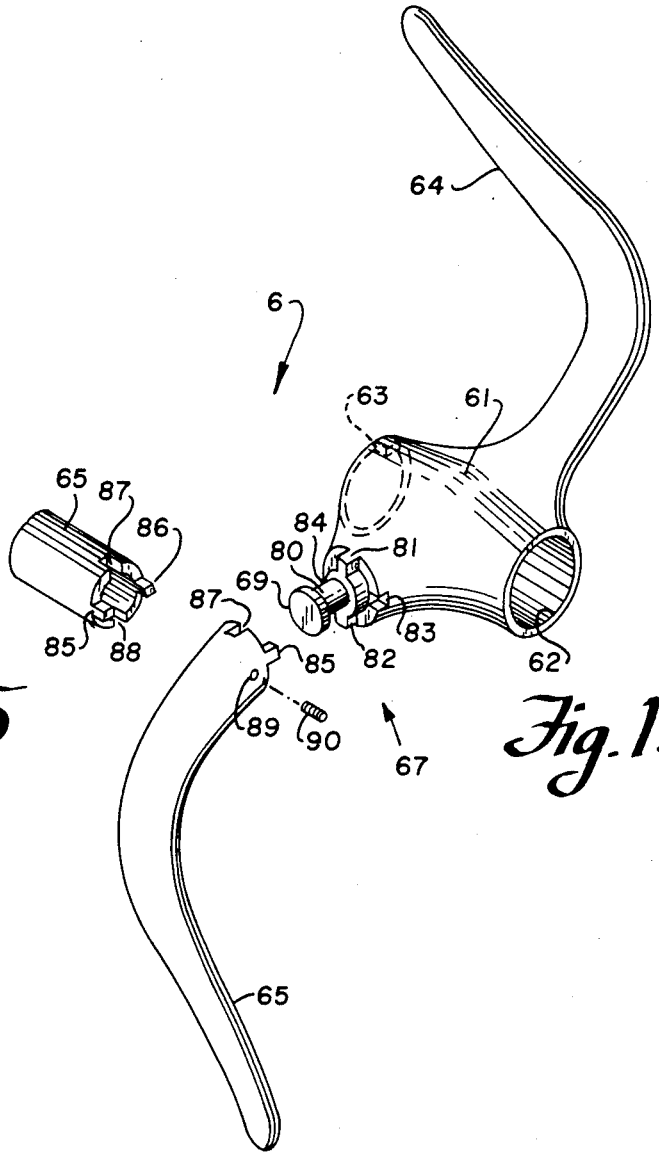
FIG. 13 is a perspective view showing the head portion and fixed hook of the sixth member in accordance with the present invention.
FIG. 14 is a disassembly view showing the movable hook of the sixth member in accordance with the present invention.
FIG. 15 is a perspective view showing part of the front end of the movable hook from another point of view.

In FIG. 11, FIG. 12 and FIG. 13 are authentic example of the sixth member of the present invention. The sixth member has a head portion 61 which has a through hole 62. Through hole 62 has a notch 63 in the inner wall thereof. Notch 63 permits, for example, the sixth member to be fitted to the first member such that the sixth member and the first member are presented from notating with respect to one another. Extending from both sides of head portion 61 are a fixed hook 64 and a movable hook 65. The fixed hook 64 is on the same trunk of head portion 61, the movable hook 65 is disposable from the faying surface 66 on head portion 61. The relative position of movable hook 65 with said head portion 61 can be changed by a locking device on the head portion 61.

The sixth member may include a locking device which comprises an axial direction device to prevent of the movable hook from disengaging from the head portion 61 after locking the parts together, a radial direction device to prevent the movable hook from turning relative to the head portion after interconnection of the components.

In the sixth member the radial direction device may further include at least two keys extending from the surface of the head portion and in the far end direction of the head portion; and at least two notch ways on the surface of the movable hook which correspond to the keys so as to prevent the movable hook from turning radially with respect to the head portion.

The sixth member may also have a radial direction device comprising a bulging portion on the surface of the head portion which has a non-round section and a grooving portion on the surface of the movable hook which has a non-circular section and by the fit in of both bulging portion and grooving portion, the turning between the head portion and the movable hook can be prevented.

The sixth member may include an axial direction device which includes a locking member on the head portion and a retainer portion extending from the movable hook to retain the locking member and thereby prevent the axial disengagement of the movable hook from the head portion.

Various features of the sixth element are illustrated in FIG. 13. As shown in FIG. 13, locking device 67 has an extending bar 68 at the outer side of faying surface. At the end of extending bar 68 is a flange 69 with a larger diameter. A neck 80 with smaller diameter extends two keys 81, 82 from the outer side of said faying surface 66 wherein the two keys are symmetrically installed at both sides of said neck 80. Two notch ways 83, 84 are symmetrically installed in the neck 80, the direction of the notch ways is the head portion 61. The center-line of the two notch ways is vertical to that of the keys 81, 82. As illustrated in FIG. 13 and FIG. 14, the faying end of the movable hook 65 has two extending keys 85, 86 which correspond to the notch ways 83 and 84, respectively, and two notch ways 87, 88 which correspond to the keys 81 and 82 respectively. The stationary and movable hook 65 has a tap hole 89 for screw 90 to lock in. When connected as illustrated in FIG. 13 and FIG. 14, the keys 85, 86 and the notch ways 87, 88 of the movable hook correspond one to one to the notch ways 83, 84 and keys 81, 82 of the head portion, from the tap hole 89 the screw 90 is locked in the neck 80 and stopped by the flange 69 to prevent the movable hook 65 disengaging from the head portion 61. When changing the relative position of the movable hook 65 and the fixed hook 64, the screw 90 is removed to let the movable hook 65 separate from the head portion 61, the moveable hook 65 is then turned 180 degrees around the central point of the neck 80 to make the keys 85, 86 and notch ways 87, 88 of the movable hook 65 correspond one to one to the notch ways 84, 83 and keys 82, 81 of the head portion, and the screw 90 is inserted into the tap hole 89 to prevent the disengaging and turning of the movable hook. After that, a connection illustrated as the solid line in FIG. 12 can be completed.

Assembly of eight Budo Weapons by the above-described six members is now described.

Figure 16:
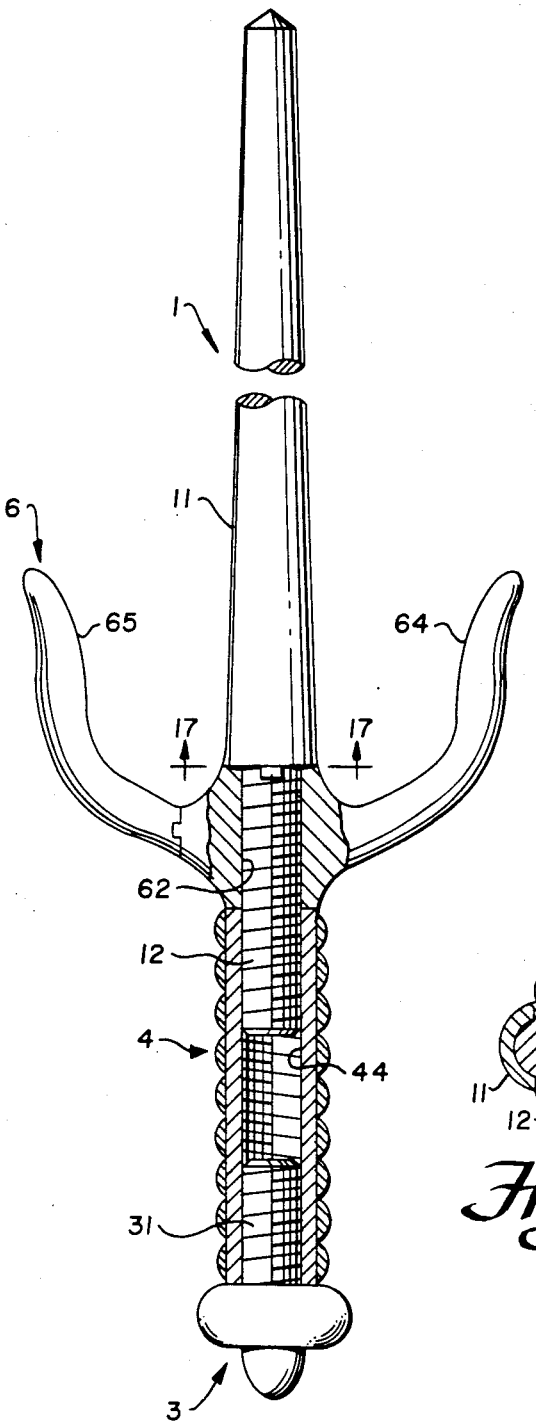
FIG. 16 is a broken sectional view showing the assembly of one of the Sai in accordance with the present invention.
Figure 17:
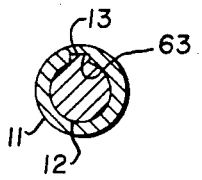
FIG. 17 is a cross sectional view taken along cut line III—III of FIG. 16.

FIG. 16 is the first kind of Budo weapon: one of Sai. The Sai are in pairs and are identical in configurations. FIG. 16 shows only one Sai. The Sai is composed of a first member 1, a third member 3, a fourth member 4 and a sixth member 6. A complete Sai can be assembled by means of the bolt 12 of the first member 1 entering into the through hole 62 of the sixth member, the key 13 of the first member corresponding to the notch ways 63 of the sixth member (see FIG. 17); the internal thread 44 at one end of the fourth member fitting with the bolt 12 of the first member 1; and the bolt portion 31 of the third member fitting with the internal thread 44 at another end of the fourth member.

Figure 18:
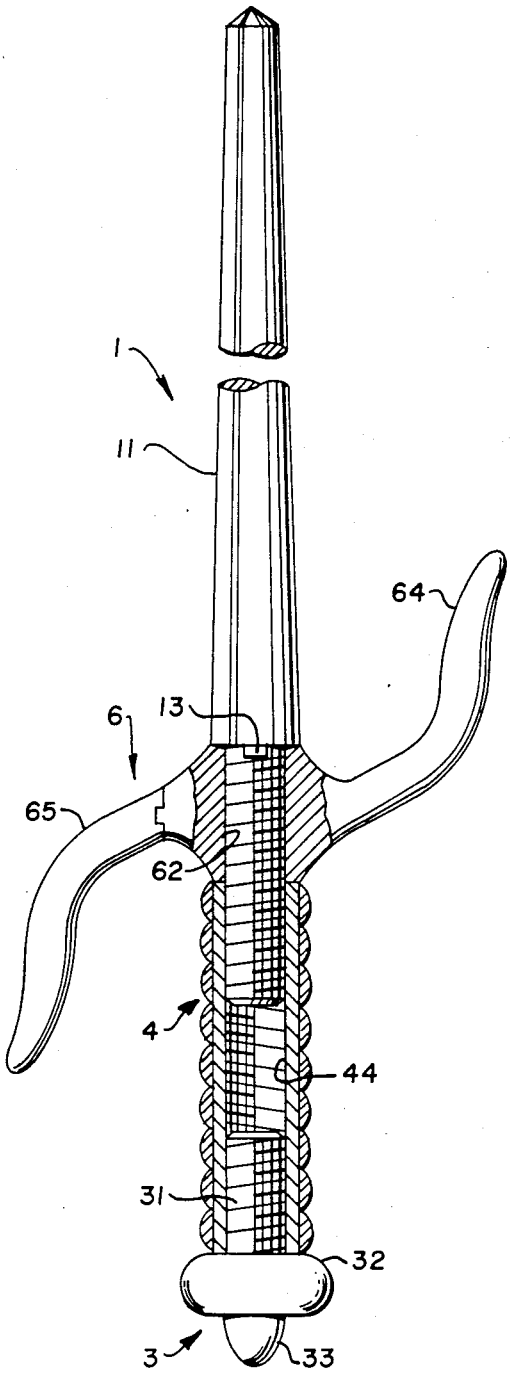
FIG. 18 is a broken sectional view showing the assembly of one of the Yin Yang Sai in accordance with the present invention.
Figure 19:
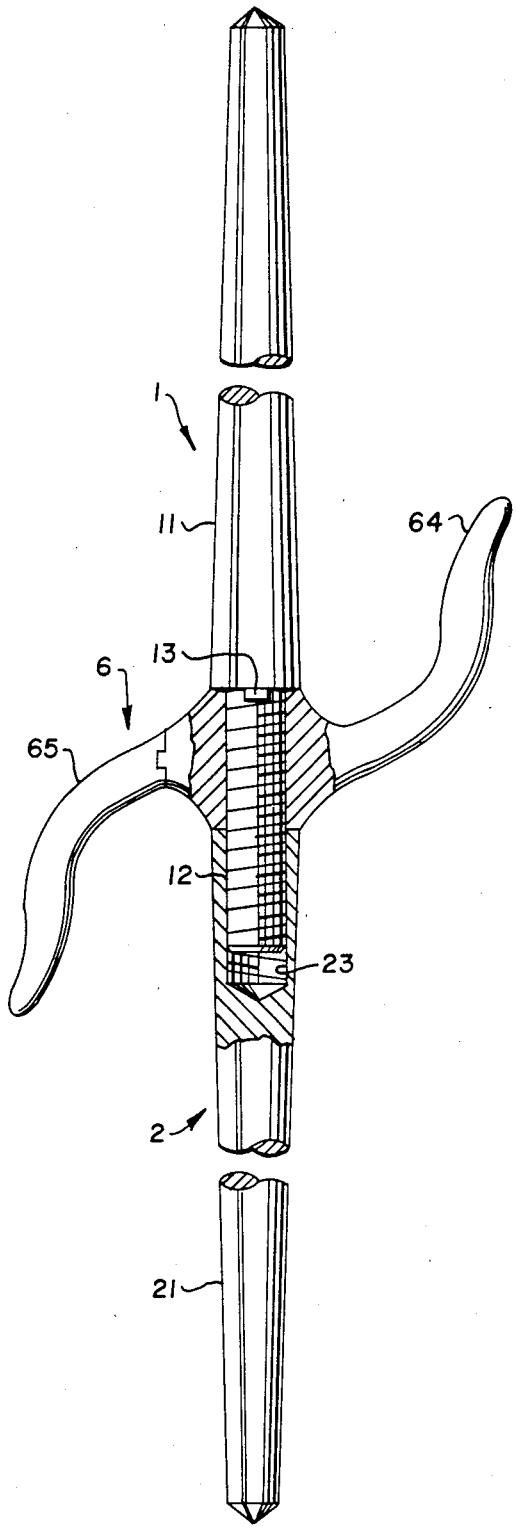
FIG. 19 is a broken sectional view showing the assembly of the Manji Sai in accordance with the present invention.

FIG. 18 is the second kind of Budo weapon a Yin Yang Sai (the Yin Yang Sai are in pairs and we thus only show one of it in the drawing). It is composed of a first member 1, a third member 3, a fourth member 4 and a sixth member 6. The relation of assembly is same as Sai in FIG. 16 except that only the movable hook 65 of sixth member 6 is downward installed. Other points are illustrated as above and will not be repeated here.

FIG. 9 is the third kind of Budo weapon a pair of Manji Sai (only one of it is shown in the drawing). It is composed of a first member 1, a sixth member 6 and a second member 2. One of the Manji is completed by fitting the sixth member in the first member 1, fitting the internal thread 23 of second member 2 into the end of the bolt portion 12 of the first member 1, and positioning the direction of the movable hook 65 of the sixth member 6 contrary to that of the fixed hook 64.

Figure 20:
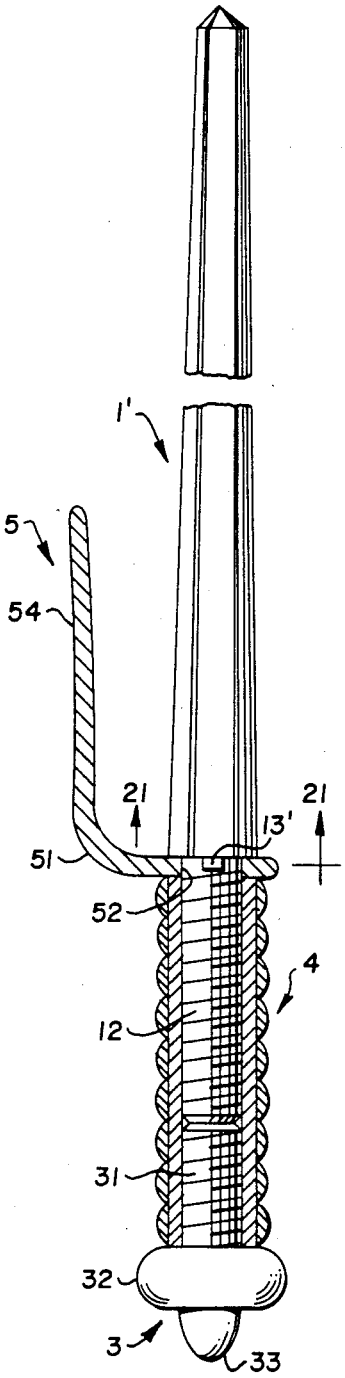
FIG. 20 is a broken sectional view showing the assembly of the Jute in accordance with the present invention.
Figure 21:
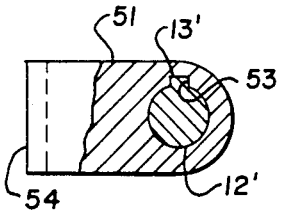
FIG. 21 is a cross sectional view taken along cut line IV—IV of FIG. 20.

FIG. 20 is the fourth kind of Budo weapon: a Jute. It is composed of a first member 1, a third member 3, a fourth member 4 and a fifth member 5. The fifth member 5 can be prevented from turning away from the first member 1 by fitting the longitudinal hole 52 of the transverse portion 51 of fifth member 5 in the base of the bolt portion 12 of first member.

Figure 22:
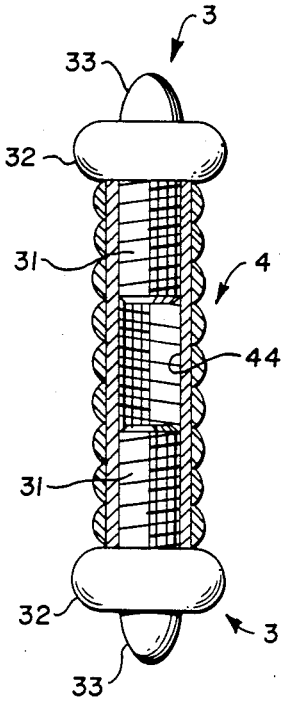
FIG. 22 is a sectional view showing the assembly of the Yawara in accordance with the present invention.
Figure 23:
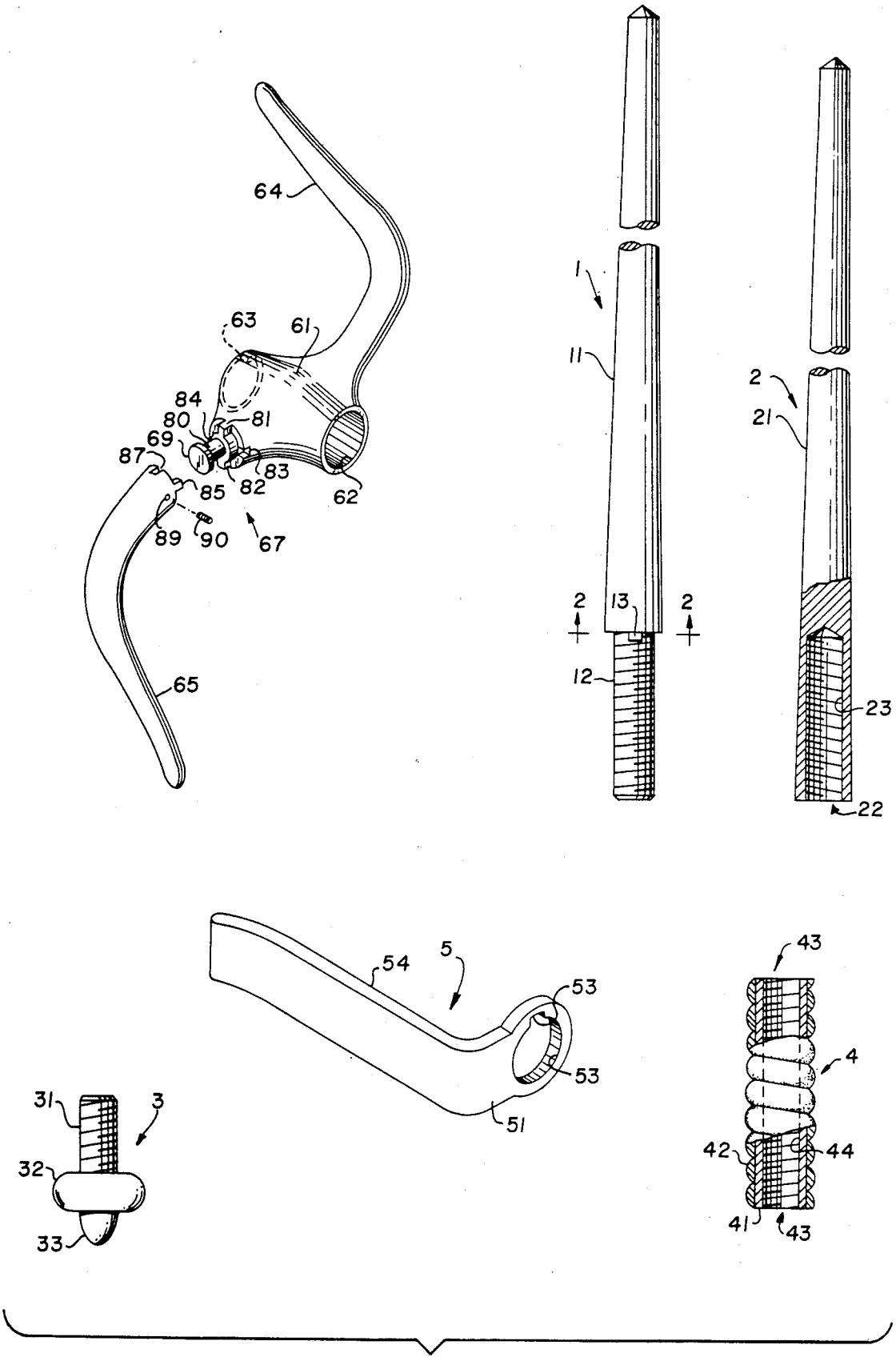
FIG. 23 illustrates the six elements from which eight different Kinds of Complex Budo Weapons may be subsequently assembled.

FIG. 22 shows the fifth kind of Budo weapon, a Yawara. It is composed of a fourth member 4 and two third members 3. A Yawara is completed by means of the bolt portion 31 of the two third members fitting in two ends of the internal thread 44 of fourth member respectively.

The sixth kind of Budo weapon is a Buffalo Hook. It is the first position of sixth member as illustrated in the solid line of FIG. 11 and FIG. 12.

The seventh kind of Budo weapon is a Manji Hook. It is the second position of sixth member as illustrated in FIG. 13 and FIG. 14 after assembly.

The eighth kind of Budo weapon is a Kubotan which is also the fourth member as illustrated in FIG. 8 and FIG. 9.

What is claimed is:

1. An apparatus having a plurality of interconnectable structural elements comprising:

a first element having a bar portion (11) with a top and bottom bar portion, and a threaded bolt (12) extending from the bottom bar portion of said bar portion;

a second element, said second element having a bar portion (21), said bar portion (21) having a base, a centralized threaded core (22, 23) extending upwardly a predetermined distance from said base;

a third element having a flange portion (32), a threaded bolt portion (31) one end of which connects to said flange portion (32), and a butt portion (33) extending from the rear end of said flange portion;

a fourth element which is a hollowed sleeve nut (4);

a fifth element having a transverse portion (51) and a longitudinal section (54), an opening in said transverse portion (52), a notch in said opening (53); and a sixth element having a central section (61), said central section having a through hole (62), said through hole having a notch on at least one end thereof (63), a fixed hook (64) extending from one side of said central section (61), and an adjustable hook (65) mounted on said central section (61); and means for locking said movable hook in a predetermined fixed relationship to said central section (61).

2. An apparatus kit having a plurality of interconnectable structural elements comprising:

an element having a bar portion (11) with a top and bottom bar portion, and a threaded bolt (12) extending from the bottom bar portion of said bar portion;

an element having a flange portion (32), a threaded bolt portion (31) one end of which connects to said flange portion (32), and a butt portion (33) extending from the rear end of said flange portion;

a hollowed sleeve nut (4);

an element having a central section (61), said central section having a through hole (62), said through hole having a notch on at least one end thereof (63), a fixed hook (64) extending from one side of said central section (61), and an adjustable hook (65) mounted on said central section (61); and means for locking said movable hook in a predetermined fixed relationship to said central section (61).

* * * * *